US011843175B2

(12) United States Patent
Wang et al.

(10) Patent No.: US 11,843,175 B2
(45) Date of Patent: Dec. 12, 2023

(54) THREE-DIMENSIONAL ANTENNA MODULE FOR TRANSMITTING AND RECEIVING ELECTROMAGNETIC MILLIMETER WAVES

(71) Applicant: Google LLC, Mountain View, CA (US)

(72) Inventors: Jibing Wang, San Jose, CA (US); Aamir Akram, San Jose, CA (US); Erik Richard Stauffer, Sunnyvale, CA (US); Sharath Ananth, Cupertino, CA (US); Chien Pin Chiu, Taoyuan (TW); Shihhao Chiu, New Taipei (TW)

(73) Assignee: Google LLC, Mountain View, CA (US)

( * ) Notice: Subject to any disclaimer, the term of this patent is extended or adjusted under 35 U.S.C. 154(b) by 365 days.

(21) Appl. No.: 17/349,113

(22) Filed: Jun. 16, 2021

(65) Prior Publication Data

US 2021/0313707 A1 Oct. 7, 2021

Related U.S. Application Data

(63) Continuation of application No. 63/163,376, filed on Mar. 19, 2021.

(51) Int. Cl.
*H01Q 21/06* (2006.01)
*H01Q 1/24* (2006.01)

(52) U.S. Cl.
CPC ..... *H01Q 21/065* (2013.01); *H01Q 1/243* (2013.01)

(58) Field of Classification Search
CPC ..... H01Q 21/065; H01Q 21/28; H01Q 1/243; H01Q 1/38; H01Q 5/40; H01Q 9/0414; H01Q 9/0421; H01Q 1/2283; H01Q 5/42; H01Q 9/045; H01Q 1/40; H01Q 1/48; H01Q 1/521; H01Q 13/10; H01Q 21/0025; H01Q 21/0075; H01Q 21/24; H01Q 21/29; H01Q 21/30; H01Q 23/00; H01Q 25/005; H01Q 3/24; H01Q 3/267; H01Q 3/28; H01Q 3/36; H01Q 5/307; H01Q 9/0407; H01Q 1/1271; H01Q 1/2258; H01Q 1/2266; H01Q 1/24; H01Q 1/246; H01Q 1/247; H01Q 1/273; H01Q 1/42; H01Q 1/46; H01Q 1/50; H01Q 1/526; H01Q 13/106;
(Continued)

(56) References Cited

U.S. PATENT DOCUMENTS 9,667,290 B2 * 5/2017 Ouyang ..... H01Q 21/062
10,658,762 B2 5/2020 Paulotto et al.
(Continued)

*Primary Examiner* — Monica C King
(74) *Attorney, Agent, or Firm* — Colby Nipper PLLC

(57) ABSTRACT

This document describes techniques and apparatuses that include a three-dimensional (3D) antenna module for transmitting or receiving electromagnetic millimeter waves (mmWaves). In general, a user equipment (UE) may include the 3D antenna module in a corner of a housing of the UE. The 3D antenna module may include three antenna panels that are generally planar and generally orthogonal to three respective axes of a Cartesian-coordinate system. The 3D antenna module may transmit and receive the electromagnetic mmWaves as part of a wireless link between the UE and another device, such as a satellite that is part of a wireless-communication network. In general, the 3D antenna module may mitigate propagation losses and allow the UE to maintain a link-budget for the wireless link.

12 Claims, 4 Drawing Sheets

(58) Field of Classification Search
CPC ..... H01Q 15/14; H01Q 19/005; H01Q 19/17; H01Q 21/0006; H01Q 21/061; H01Q 21/062; H01Q 21/064; H01Q 21/08; H01Q 21/205; H01Q 21/22; H01Q 25/00; H01Q 25/007; H01Q 3/26; H01Q 3/30; H01Q 3/38; H01Q 5/20; H01Q 5/30; H01Q 5/35; H01Q 5/371; H01Q 5/378; H01Q 7/00; H01Q 9/065; H01Q 9/14; H01Q 9/16; H01Q 9/285; H01Q 9/40; H01Q 9/42; H04B 17/14; H04B 17/19; H04B 1/006; H04B 1/03; H04B 1/04; H04B 1/1081; H04B 1/40; H04B 17/12; H04B 17/21; H04B 2001/0408; H04B 7/0413; H04B 7/043; H04B 7/0602; H01L 2223/6627; H01L 2223/6677; H01L 2924/1517; H01L 23/552; H01P 1/203; H01P 3/088; H04W 16/28; H04W 4/80; H04W 52/32; H04W 52/367; H04W 88/08; H05K 3/4626
See application file for complete search history.

(56) References Cited

U.S. PATENT DOCUMENTS

| | | | | |
|---|---|---|---|---|
| 11,367,945 | B2 * | 6/2022 | Son | H04M 1/0277 |
| 2016/0308626 | A1 * | 10/2016 | Mow | H04B 17/14 |
| 2018/0159203 | A1 * | 6/2018 | Baks | H01Q 9/045 |
| 2020/0091608 | A1 | 3/2020 | Alpman et al. | |
| 2020/0161745 | A1 | 5/2020 | Khripkov et al. | |
| 2021/0218213 | A1 * | 7/2021 | Cohen | H01S 1/02 |

* cited by examiner

THREE-DIMENSIONAL ANTENNA MODULE FOR TRANSMITTING AND RECEIVING ELECTROMAGNETIC MILLIMETER WAVES

RELATED APPLICATION

This application claims priority to U.S. Provisional Application Ser. No. 63/163,376, filed Mar. 19, 2021, which is incorporated herein by reference in its entirety.

SUMMARY

This document describes techniques and apparatuses that include a three-dimensional (3D) antenna module for transmitting or receiving electromagnetic millimeter waves (mmWaves). In general, a user equipment (UE) may include the 3D antenna module in a corner of a housing of the UE. The 3D antenna module may include three antenna panels that are generally planar and generally orthogonal to three respective axes of a Cartesian-coordinate system. The 3D antenna module may transmit and receive the electromagnetic mmWaves as part of a wireless link between the UE and another device, such as a satellite that is part of a wireless-communication network. In general, the 3D antenna module may mitigate propagation losses and allow the UE to maintain a link-budget for the wireless link.

This Summary is provided to introduce simplified concepts of techniques and apparatuses drawn to a 3D antenna module, the concepts of which are further described below in the Detailed Description and Drawings. This Summary is not intended to identify essential features of the claimed subject matter, nor is it intended for use in determining the scope of the claimed subject matter.

BRIEF DESCRIPTION OF THE DRAWINGS

The details of one or more aspects of techniques and apparatuses using a 3D antenna module for transmitting and receiving electromagnetic mmWaves are described in this document with reference to the following drawings. The same numbers are used throughout the drawings to reference like features and components.

DETAILED DESCRIPTION

This document describes techniques and apparatuses that include a 3D antenna module for transmitting and receiving electromagnetic mmWaves. In general, a UE may include the 3D antenna module in a corner of a housing of the UE. The 3D antenna module may include three antenna panels that are generally planar and generally orthogonal to three respective axes of a Cartesian-coordinate system. The 3D antenna module may transmit and receive the electromagnetic mmWaves as part of a wireless link between the UE and another device, such as a satellite that is part of a wireless-communication network. In general, the 3D antenna module may mitigate propagation losses and allow the UE to maintain a link-budget for the wireless link.

The techniques and apparatuses may have utility for a variety of embodiments in which electromagnetic mmWaves are transmitted and/or received. For example, and in addition to wireless communications with a satellite, the techniques and apparatuses may apply to wireless communications with a Fifth-Generation New Radio (5GNR) base station, radar signaling by the UE, and so on.

Figure 1:
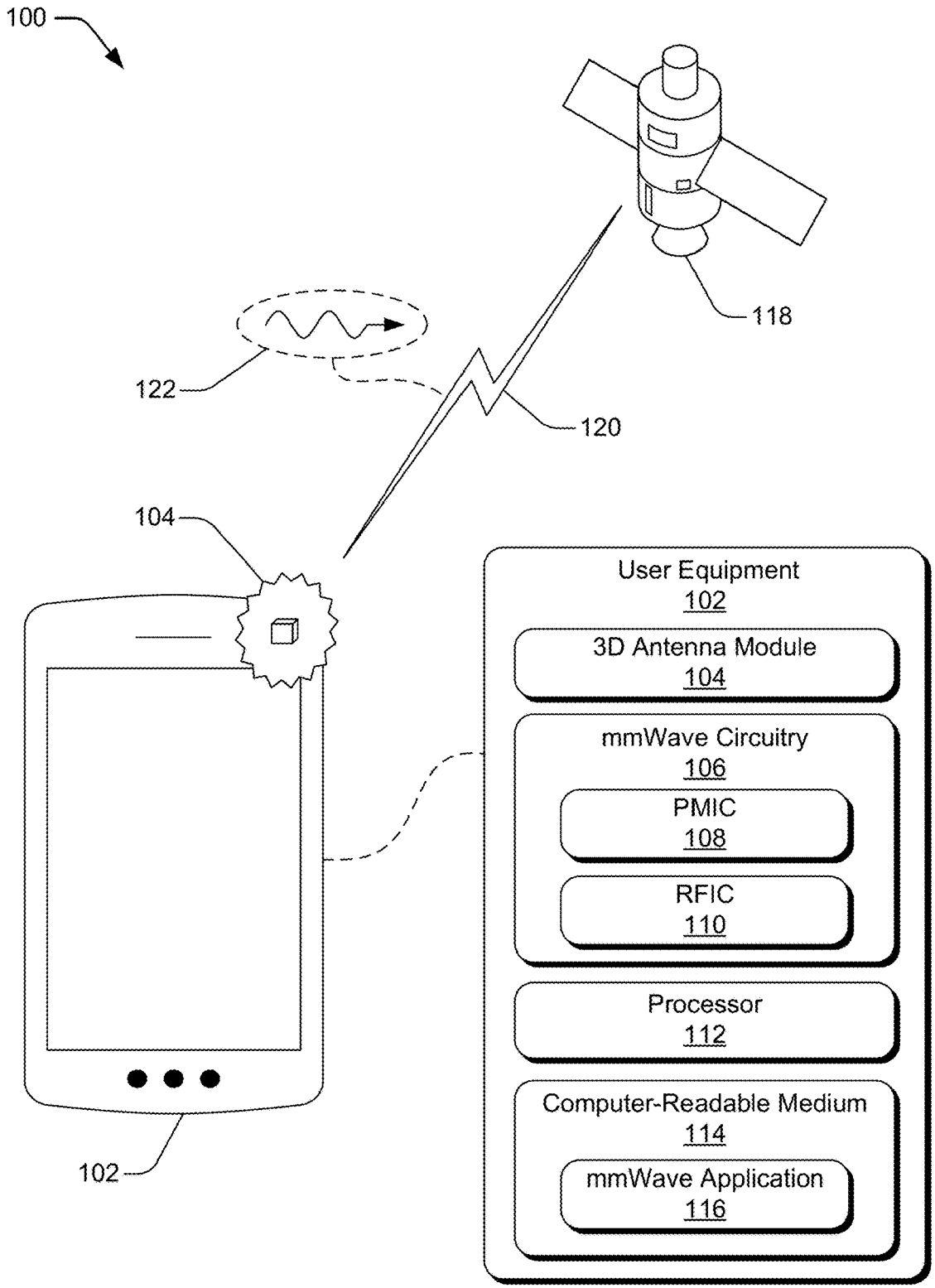
FIG. 1 illustrates example details of UE using a 3D antenna module for wireless communications with another device.

FIG. 1 illustrates example details 100 of a UE 102 using a 3D antenna module 104 for wireless communications with another device. Although FIG. 1 illustrates the UE 102 as a smartphone, the UE 102 may take a variety of forms, such as a wireless navigation system in an automobile, a tablet, a personal Global Navigation Satellite System (GNSS) device, and so on.

The 3D antenna module 104, to be described in greater detail below, may be shaped as a general cuboid and located within a corner of a housing of the UE 102. In general, the 3D antenna module 104 may include three antenna panels that are generally planar and generally orthogonal to one another.

A primary plane of each panel may be orthogonal to an axis of a Cartesian-coordinate system. Due to a resulting multi-axis orientation of the three antenna panels, the 3D antenna module 104 may transmit or receive electromagnetic waves through different surfaces of the UE 102 (e.g., a top surface, a side surface, and a rear surface of the UE 102), mitigating propagation losses and allowing the UE 102 to maintain a link-budget (e.g., operate below a transmission or reception power threshold in decibels (dB)) for the wireless link 120. In some instances, the 3D antenna module 104 may be positioned within a corner of a housing of the UE 102 such that other features of the UE (e.g., a display, a camera module, and so on) do not interfere with transmission and/or reception operations performed by the 3D antenna module 104.

In addition to the 3D antenna module 104, the UE 102 includes mmWave circuitry 106. The mmWave circuitry 106 may include at least one power-management integrated circuit (PMIC) 108 and at least one radio-frequency integrated circuit (RFIC) 110. In some instances, portions of the mmWave circuitry 106 (including the PMIC 108 and/or the RFIC 110) may be included within the 3D antenna module 104.

The UE 102 also includes at least one processor 112 and a computer-readable storage medium (CRM) 114. The processor 112 may include a single-core processor or a multiple-core processor composed of a variety of materials, such as silicon, polysilicon, high-K dielectric, copper, and so on.

In the context of this discussion, the CRM 114 of the UE 102 is a hardware-based storage medium, which does not include transitory signals or carrier waves. As an example, the CRM 114 may include one or more of a read-only memory (ROM), a Flash memory, a dynamic random-access memory (DRAM), a NOR memory, a static random-access memory (SRAM), and so on.

The CRM 114 includes executable code or instructions of a mmWave application 116 that, when executed by the processor 112, may cause the UE 102 to wirelessly communicate with another device, such as a satellite 118. Examples of the mmWave application 116 include a wireless-communication application for transmitting or receiving electromagnetic mmWave signals (e.g., electromagnetic waves operating at a frequency between approximately 30 Gigahertz (GHz) and 300 GHz and having a wavelength between approximately 10 mm and 1 mm) that carry audio or video content with the satellite 118, a tracking application that receives mmWave signals from the satellite 118 for navigation purposes, and so on.

The UE 102 may wirelessly communicate with the satellite 118 using a wireless link 120, through which the UE 102 may transmit and/or receive one or more permutations of combinations of electromagnetic mmWaves(s) 122 (e.g., permutations and combinations of the electromagnetic mmWaves(s) 122 having different wavelengths, frequencies, or polarizations). Transmitting and receiving electromagnetic mmWaves(s) 122 may include the processor 112, the mmWave application 116, and the mmWave circuitry 106 working in unison to transmit or receive the electromagnetic mmWaves(s) 122 through the 3D antenna module 104.

Although illustrated as wirelessly communicating with the satellite 118, the UE 102 may wirelessly communicate the electromagnetic mmWaves(s) 122 with other devices, such as a 5GNR base station. The UE 102 may also wirelessly transmit and receive the electromagnetic mmWaves(s) 122 as part of a radar sensing operation.

Figure 2:
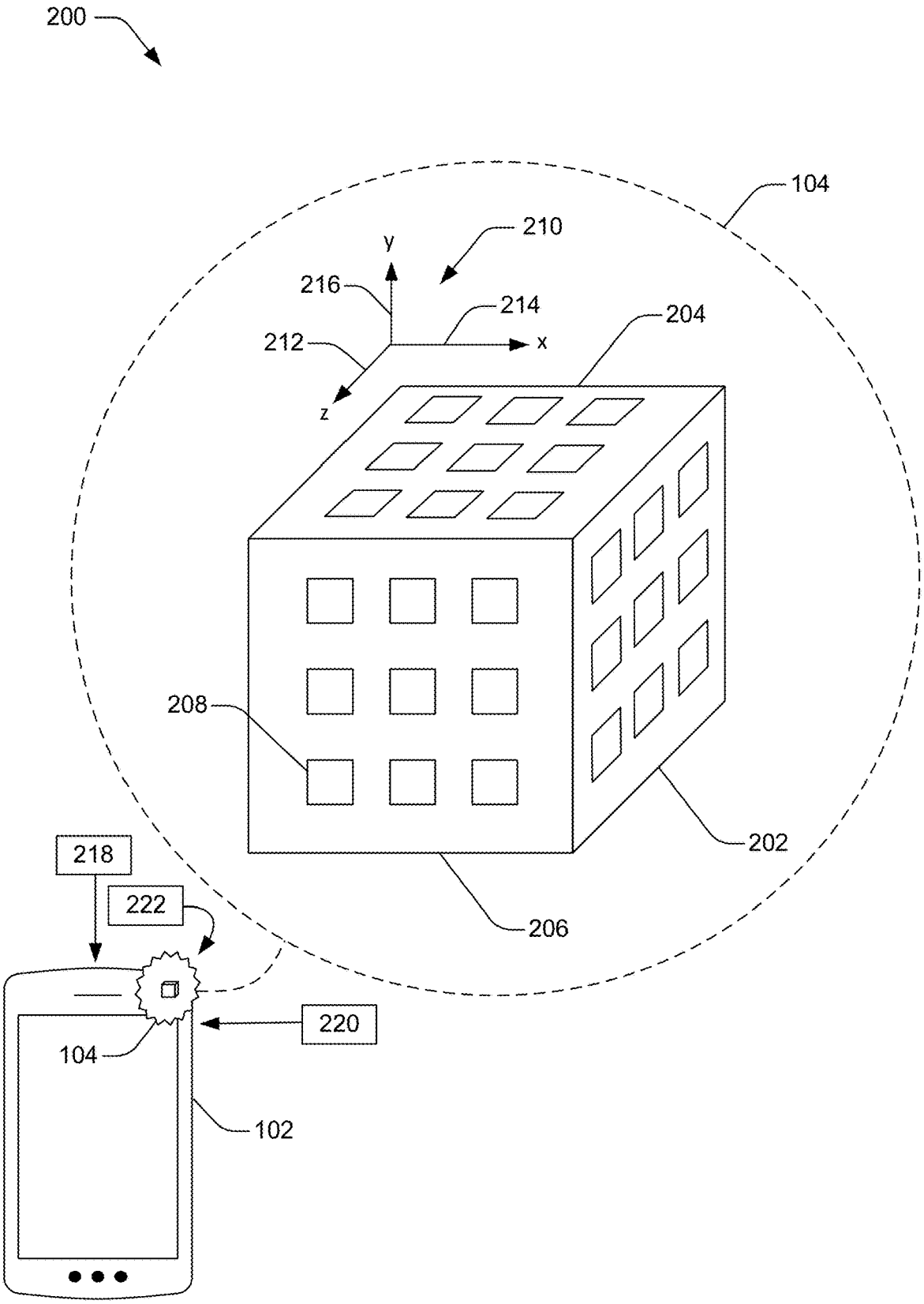
FIG. 2 illustrates example details of a 3D antenna module.

FIG. 2 illustrates example details 200 of the 3D antenna module 104. As illustrated, the 3D antenna module 104 includes three antenna panels (e.g., antenna panel 202, antenna panel 204, and antenna panel 206) that are joined in a cuboid shape. Each antenna panel may transmit different permutations and combinations of the electromagnetic mmWaves(s) 122.

The three antenna panels 202, 204, 206 may include substrates that are fabricated using a variety of manufacturing techniques. As an example, the three antenna panels may include at least one substrate that is fabricated using multilayer printed circuit board (PCB) manufacturing techniques. As another example, the three antenna panels may include at least one substrate that is fabricated using semiconductor manufacturing techniques that include applying one or more metallic redistribution layers (RDLs) to a silicon or ceramic substrate.

Each antenna panel 202, 204, 206 may be generally planar and include an array of one or more antenna element(s) 208. Each of the antenna element(s) 208 may include a metal material such as copper (Cu) or Aluminum (Al) material. Layouts of respective arrays of the antenna elements(s) 208 may enable the 3D antenna module to transmit and receive the mmWave(s) 122 using beamforming techniques. In general, each of the antenna element(s) 208 may be: spaced from other antenna elements on the substrate associated with the panel 202, 204, 206; may be tuned for mmWaves; may communicatively couple to the mmWave circuitry 106 of FIG. 1; and/or may be independently controlled to dynamically produce different desired characteristics for the antenna module.

The 3D antenna module 104 is, generally, at least partially a cuboid shape. As part of the cuboid shape, a primary plane of each antenna panel may generally be orthogonal to an axis of a Cartesian-coordinate system 210. For example, and as illustrated, the antenna panel 202 (e.g., a primary plane of the antenna panel 202) may be orthogonal to an x-axis 214, the antenna panel 204 (e.g., a primary plane of the antenna panel 204) may be orthogonal to a y-axis 216, and the antenna panel 206 (e.g., a primary plane of the antenna panel 206) may be orthogonal to a z-axis 212. In general, the 3D antenna module 104 may transmit the electromagnetic mmWaves(s) 122 emitted by antenna elements 208 through a top surface 218, a side surface 220, or a rear surface 222 of the UE 102.

The antenna elements 208 of panels 202, 204, 206 of the 3D antenna module 104 may be configured to transmit or receive the electromagnetic mmWaves(s) 122 using similar polarization techniques. For example, the respective antenna elements 208 may be controlled such that the antenna panel 202, the antenna panel 204, and the antenna panel 206 may each be configured to transmit or receive the electromagnetic mmWaves(s) 122 using dual linear-polarization or circular-polarization techniques.

Alternatively, the antenna elements 208 of panels 202, 204, 206 of the 3D antenna module 104 may be configured to transmit or receive the respective antenna elements 208 may be controlled such that the electromagnetic mmWaves(s) 122 use different polarization techniques. For example, the respective antenna elements 208 of the antenna panels 202, 204, 206 may be controlled effective to cause the antenna panel 202 to transmit or receive a portion of the electromagnetic mmWaves(s) 122 using dual linear-polarization techniques while causing the antenna panel 204 or the antenna panel 206 to transmit or receive another portion of the electromagnetic mmWaves(s) 122 using circular-polarization techniques.

In some instances, the respective antenna elements 208 of at least two of the antenna panel 202, the antenna panel 204, or the antenna panel 206 may concurrently transmit or receive respective portions of the electromagnetic mmWaves(s) 122. In other instances, the respective antenna elements 208 of at least two of the antenna panel 202, the antenna panel 204, or the antenna panel 206 may asynchronously (e.g., independently from one another) transmit or receive respective portions of the electromagnetic mmWaves(s) 122.

Antenna panels of the 3D antenna module 104 may perform simultaneous transmission and reception operations. For example, the respective antenna elements 208 of at least one of the antenna panel 202, the antenna panel 204, or the antenna panel 206 may transmit one portion of permutations of the electromagnetic mmWaves(s) 122 while the respective antenna elements 208 of at least another of the antenna panel 202, the antenna panel 204, or the antenna panel 206 receives another portion of the electromagnetic mmWaves(s) 122.

Other operations supported by the 3D antenna module 104 may include establishing separate wireless links with separate devices. For example, the 3D antenna module 104 may use the antenna elements 208 of antenna panel 202 to establish a first wireless link with a first satellite (e.g., a first instance of the wireless link 120 with the satellite 118 of FIG. 1) and the antenna elements 208 of antenna panel 204 to establish a second wireless link with a second satellite (e.g., a second, different instance of the wireless link 120 with a second, different instance of the satellite 118 of FIG. 1). The 3D antenna module 104 may further use the antenna elements 208 of antenna panel 206 to establish a third wireless link with a third satellite (e.g., a third, different instance of the wireless link 120 with a third, different instance of the satellite 118 of FIG. 1). Each wireless link may use different combinations or permutations of the mmWave(s) 122 (e.g., different frequency bands).

Establishing the three separate wireless links with three separate satellites may support satellite tracking operations and may further help handover or multi-connectivity across the three separate satellites. To compensate for different velocities and/or orbits of the three separate satellites, a wireless application controlling transmission and reception operations through the 3D antenna module 104 (e.g., the mmWave application 116 of FIG. 1) may compute doppler pre-compensation offsets or delay compensation offsets for different, respective antenna panels.

The 3D antenna module 104 may also support multiplexing operations. Examples of multiplexing operations supported by the 3D antenna module include frequency division duplexing (FDD) or time division duplexing (TDD). The multiplexing operations may enable antenna elements 208 of different panels to operate using different frequency bands.

Figure 3:
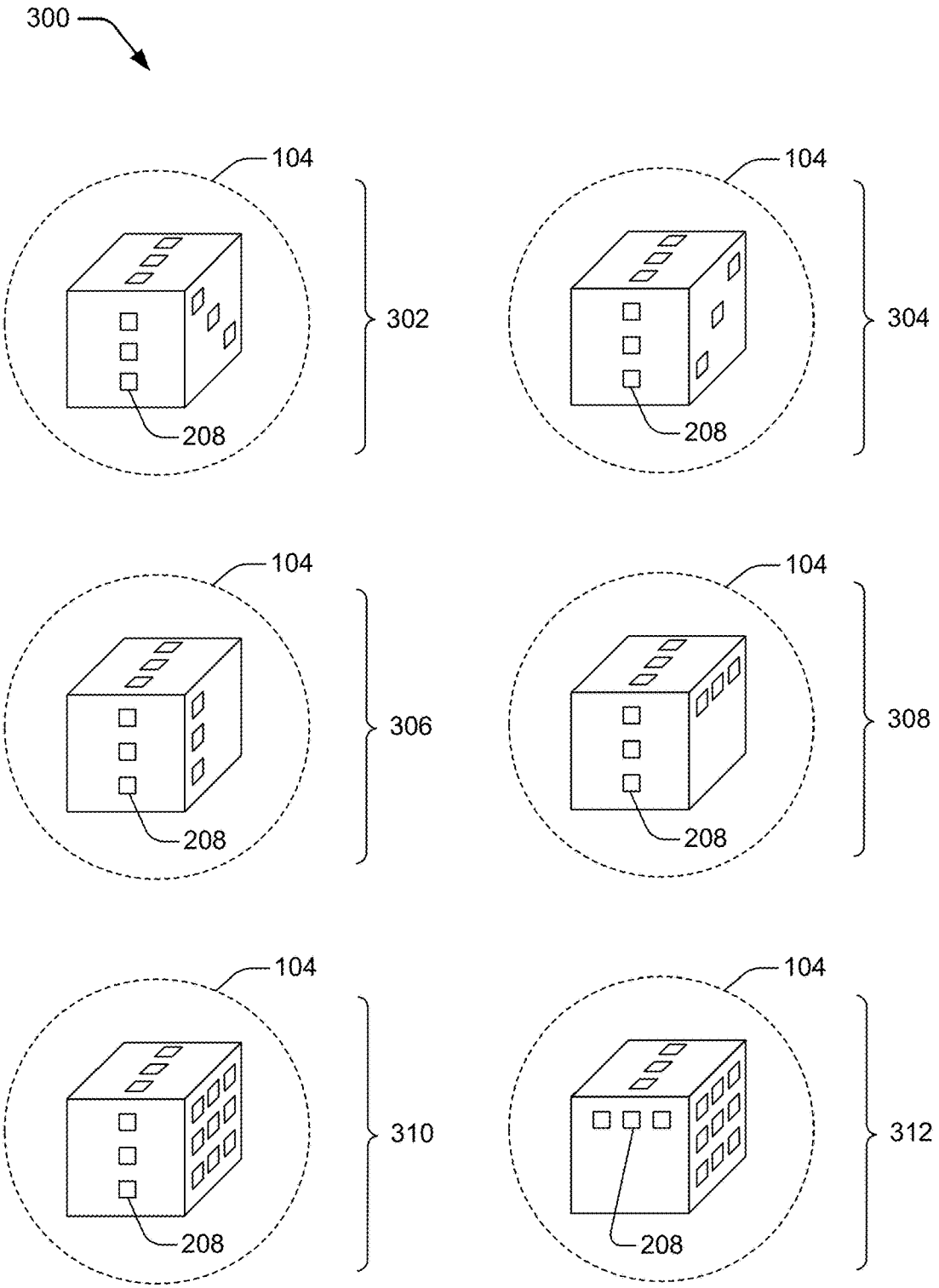
FIG. 3 illustrates example antenna array configurations of a 3D antenna module.

FIG. 3 illustrates example antenna array configurations 300 of antenna elements 208 of the 3D antenna module 104. The array configurations of antenna elements 208, sometimes referred to as phased-array configurations, may be implemented in the 3D antenna module 104 to combine radiation patterns of electromagnetic mmWaves transmitted or received by the 3D antenna module 104 to form or directionally steer beams (e.g., beamform electromagnetic mmWaves).

Example configurations 302 and 304 illustrate possible arrangements of antenna elements 208 configured as single-axis arrays (e.g., 1×3) arranged within planes of the 3D antenna module 104. As illustrated, different orientations of antenna elements 208 in single-axis arrays within the planes of the 3D antenna module 104 are possible.

Example configurations 306 and 308 illustrate other possible arrangements of antenna elements 208 in single-axis arrays (e.g., 1×3) arranged within planes of the 3D antenna module 104. Although the single-axis arrays of antenna elements 208 are positioned along axes that are generally parallel to a Cartesian coordinate system, locations of the single-axis arrays may vary with respect to proximity to central regions or edge regions of the 3D antenna module 104.

Example configurations 310 and 312 illustrate example combinations of antenna elements 208 in single-axis arrays (e.g., 1×3) and multi-axis arrays (e.g., 3×3) arranged within planes of the 3D antenna module 104. As illustrated, orientations of antenna elements 208 in single-axis arrays may vary.

In general, and with respect to FIG. 3, additional configurations and combinations of arrays of antenna elements 208 are possible. The example configurations 302-312 are but a few of many possible configurations of antenna elements 208 that may be implemented based on desired beamforming operations by the 3D antenna module 104.

Figure 4:
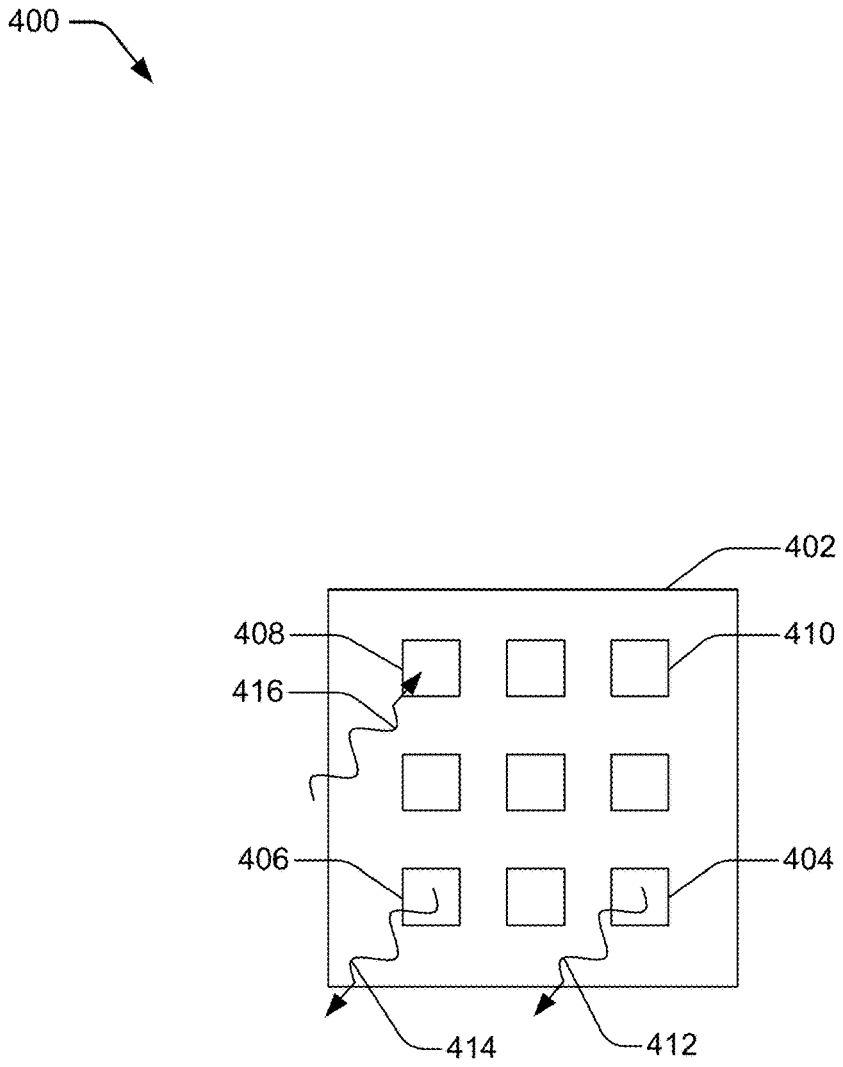
FIG. 4 illustrates example details of an antenna panel of a 3D antenna module transmitting and receiving electromagnetic mmWaves.

FIG. 4 illustrates example details 400 of an antenna panel of a 3D antenna module transmitting and receiving electromagnetic mmWaves in accordance with one or more aspects. In general, the antenna panel 402 of FIG. 4 may correspond to any of the previously mentioned antenna panels (e.g., the antenna panel 206 of FIG. 2), while the antenna elements 404-410 may each be an instance of the antenna element 208 of FIG. 2. Furthermore, the electromagnetic mmWaves 412-416 may be included as portions of the mmWaves 122 of FIG. 1.

Each of the antenna elements 404-410 may be independently controlled (e.g., by the processor 112, the mmWave application 116, and the mmWave circuitry 106 of FIG. 1) to dynamically produce different desired characteristics for the antenna module. The characteristics may relate to directionally transmitting or receiving electromagnetic mmWaves, beamforming electromagnetic mmWaves through constructive and/or destructive interference, transmitting or receiving electromagnetic mmWaves using different use different, computed doppler pre-compensation or delay compensation offsets, and so on.

As an example, and as illustrated in FIG. 4, the antenna element 404 and the antenna element 406 may be controlled to actively transmit electromagnetic mmWaves (e.g., an electromagnetic mmWave 412 and an electromagnetic mmWave 414) while the antenna element 408 is independently controlled to actively receive an electromagnetic mmWave 416. Furthermore, as illustrated in FIG. 4, the antenna element 410 may be independently controlled to neither transmit or receive an electromagnetic mmWave (e.g., the antenna element 410, as illustrated in FIG. 4, is passive).

In general, through one or more switching mechanisms (e.g., mechanisms included in the mmWave circuitry 106 of FIG. 1), the antenna elements 404-410 may be independently controlled. Furthermore, and with respect to different antenna array configurations (e.g., the configurations 302-312 of FIG. 3), many dynamically produced transmission and reception characteristics are possible.

The preceding discussion describes techniques and apparatuses related to a 3D antenna module. These techniques may be realized using one or more of the entities or components shown in FIGS. 1-4, which may be further divided, combined, and so on. Thus, these figures illustrate some of the many possible systems or apparatuses capable of employing the described techniques.

What is claimed is:

1. A user equipment comprising:

millimeter-wave circuitry;

a three-dimensional millimeter-wave module located within a corner of a housing of the user equipment, the three-dimensional millimeter-wave module including three antenna panels having respective arrays of antenna elements, wherein each antenna panel is:

generally planar; and generally orthogonal to another antenna panel of the three antenna panels;

a processor; and a computer-readable storage medium storing instructions of a millimeter-wave application that, upon execution by the processor, directs the millimeter-wave circuitry to transmit or receive electromagnetic millimeter-waves through the three-dimensional millimeter-wave module.

2. The user equipment as recited by claim 1, wherein the millimeter-wave circuitry and the three-dimensional millimeter-wave module use dual linear-polarization to directionally transmit or receive a portion of the electromagnetic millimeter-waves through at least one of the three antenna panels.

3. The user equipment as recited by claim 1, wherein the millimeter-wave circuitry and the three-dimensional millimeter-wave module use circular-polarization to transmit or receive a portion of the electromagnetic millimeter-waves through at least one of the three antenna panels.

4. The user equipment as recited by claim 1, wherein the millimeter-wave circuitry and the three-dimensional millimeter-wave module use frequency division duplexing to transmit or receive a portion of the electromagnetic millimeter-waves through at least one of the three antenna panels.

5. The user equipment as recited by claim 1, wherein the millimeter-wave circuitry and the three-dimensional millimeter-wave module use time division duplexing to transmit or receive a portion of the electromagnetic millimeter-waves through at least one of the three antenna panels.

6. The user equipment as recited by claim 1, wherein the millimeter-wave application further directs the user equipment to:

receive signals from a first device using a first antenna panel of the three antenna panels and a first frequency band associated with millimeter-wave transmission; and receive signals from a second device using a second antenna panel of the three antenna panels and a second frequency band associated with millimeter-wave transmission.

7. The user equipment as recited by claim 1 wherein the millimeter-wave application further directs the user equipment to, as part of transmitting or receiving the electromagnetic millimeter-waves, use different, computed doppler pre-compensation offsets or delay compensation offsets for each of the three antenna panels.

8. The user equipment as recited by claim 1, wherein the three-dimensional millimeter-wave module includes a radio-frequency integrated circuit.

9. The user equipment as recited by claim 1, wherein the three-dimensional millimeter-wave module includes a power-management integrated circuit.

10. The user equipment as recited by claim 1, wherein at least one of the three antenna panels includes a multi-layer printed circuit board substrate, a silicon substrate, or a ceramic substrate.

11. The user equipment as recited by claim 1, wherein at least one of the respective arrays of antenna elements includes a single-axis array of antenna elements.

12. The user equipment as recited by claim 1, wherein at least one of the respective arrays of antenna elements includes a multi-axis array of antenna elements.

* * * * *